United States Patent [19]

Diehm et al.

[11] Patent Number: 4,923,508

[45] Date of Patent: May 8, 1990

[54] SEGMENTED INDUCTION SKULL MELTING CRUCIBLE AND METHOD

[75] Inventors: Randall S. Diehm, Whitehall; Blake K. Zuidema, Muskegon, both of Mich.

[73] Assignee: Howmet Corporation, Greenwich, Conn.

[21] Appl. No.: 348,595

[22] Filed: May 8, 1989

[51] Int. Cl.[5] ..... C22B 4/00; H05B 6/16

[52] U.S. Cl. ..... 75/10.14; 75/10.18; 75/65R 373/163; 373/165

[58] Field of Search ..... 75/10.14–10.18, 75/65 R; 373/163, 165

[56] References Cited

U.S. PATENT DOCUMENTS

| | | | |
|---|---|---|---|
| 2,091,087 | 8/1937 | Wempe | 75/10 |
| 3,014,255 | 12/1961 | Bussard et al. | 22/209 |
| 3,223,519 | 12/1965 | Shippereit | 75/10.14 |
| 3,598,168 | 8/1971 | Clark | 164/51 |
| 3,775,091 | 11/1973 | Clites | 75/10.17 |
| 4,058,668 | 11/1977 | Clites | 13/32 |
| 4,738,713 | 4/1988 | Stickle | 75/10.14 |

OTHER PUBLICATIONS

Cold-Crucible Induction Melting of Reactive Metals, G. H. Schippereit et al, 2-61, pp. 140–143.

Induction Heating Process for Melting Titanium, Reactive Metals, Inc. 7-64.

Preparation of Ingots & Shaped Castings by Inductoslag Melting, 10-16, 18-74, P. G. Clites and R. A. Beall.

The Inductoslag Melting Process, P. G. Clites, 1982, pp. 6–10, FIGS. 1–4, 6–10, 12, 14–16, 19 and 20.

Inductoslag Melting of Titanium, 1969, P. G. Clites and R. A. Beall, FIGS. 1–4.

*Primary Examiner*—Peter D. Rosenberg

*Attorney, Agent, or Firm*—Reising, Ethington, Barnard, Perry & Milton

[57] ABSTRACT

The crucible includes an upstanding sidewall formed of a plurality of internally cooled, metal segments arranged in side-by side relation to form a crucible chamber for receiving the metal to be melted. The segments are separated from one another by longitudinal gaps that communicate on the inside with the crucible chamber and extend outwardly to the exterior of the sidewall. The gaps are free of packing material that could constitute a potential source of melt contamination and are so sized in a width dimension where the gap and the chamber communicate as to substantially prevent penetration of molten metal into the gaps when the metal charge is initially melted in the crucible chamber prior to the development of a solidified metal skull. Upper portions of the crucible segments are restrained against outward spreading during use to provide a crucible durable enough for use in production melting applications. The crucible eliminates the need for a $CaF_2$ type lining (skull) and for intersegment refractory packing material, thereby improving melt cleanliness.

27 Claims, 2 Drawing Sheets

SEGMENTED INDUCTION SKULL MELTING CRUCIBLE AND METHOD

FIELD OF THE INVENTION

The invention relates to the induction melting of metals and alloys in a cooled, segmented, metal crucible.

BACKGROUND OF THE INVENTION

Induction melting processes and apparatus using a water cooled, segmented, copper crucible have been developed by the U.S. Bureau of Mines, for example as described in U.S. Pat. Nos. 3,775,091 and 4,058,668. These patents illustrate use of a $CaF_2$ skull in the crucible and refractory packing material/spacers between the crucible segments to electrically isolate the crucible segments. The $CaF_2$ type skull prevents contact between the molten metal and the crucible segments. Typically, the $CaF_2$ is melted and solidified on the cooled inner walls of the metal crucible segments to form an insulating lining or skull between the melt and the crucible.

U.S. Pat. No. 4,738,713 illustrates an induction melting process wherein a reactive metal is melted in a water cooled, segmented copper crucible in the absence of a $CaF_2$ lining or skull. In this patent, a refractory packing material is required between the tubular segments of the crucible to avoid molten metal penetration therebetween and subsequent skull locking.

Crucible designs of the type shown in these patents typically are based on fabrication of the segmented crucible sidewalls from a single monolithic copper forging wherein a sidewall of the forging is cut or machined to form a plurality of side-by-side segments with a relatively large gap width between the segments; e.g., a gap width of 0.010 inch or greater. As mentioned above, alumina spacers and/or refractory packing materials are provided in each gap to keep the crucible segments electrically separated and to inhibit molten metal penetration into the intersegment gaps.

Recent trends in the aerospace industry have sought to improve part service life by increasing cleanliness of the part; i.e., by reducing the quantity of harmful nonmetallic inclusions in the part microstructure. Although aforementioned U.S. Pat. Nos. 3,775,091 and 4,058,668 replace the ceramic melting pot heretofore used in conventional induction melting with the water cooled, segmented Cu crucible as a way to eliminate a known source of melt contamination (i.e., the ceramic melting pot), the use of a $CaF_2$ type lining in the crucible unfortunately introduces another source of melt contamination as recognized in Technical Bulletin 675 "The Inductoslag Melting Process", U.S. Department Of The Interior, Bureau of Mines (1982). Moreover, the ceramic spacers and/or, refractory packing material positioned in the gaps between the crucible segments have been found to constitute still another source of contamination. For example, the ceramic spacers have been observed to break up during melting, presumably from thermal shock, with pieces of the spacers falling into the casting mold when the crucible is tilted to cast the melt into the mold.

Moreover, although U.S. Pat. No. 4,738,713 eliminates the need for the $CaF_2$ type lining (skull) in a segmented, copper crucible, this patent still requires a high temperature refractory packing in the gap between the segments from the top to the bottom thereof to prevent molten metal penetration between the segments. Thus, a source of melt contamination is still present in the crucible in the form of the refractory material packed in the intersegment gaps.

Furthermore, water cooled, segmented, copper crucibles heretofore used are known to suffer physical damage in use. This damage is in the form of outward spreading and/or bending of the upper portions of the crucible segments resulting from loading of the metal charge into the crucible chamber and from removing of the skull from the crucible. Segment spreading and/or bending is harmful to the casting process in that the $CaF_2$ type lining, if used, and/or refractory packing material between the segments can break loose and fall into and contaminate the melt.

There thus is a need in the art for a segmented, metal crucible which eliminates altogether the presence of a $CaF_2$ type lining in the crucible and also refractory packing material and/or spacers in the gaps between crucible segments so as to improve melt cleanliness. There is also a need in the art to provide a segmented, metal crucible wherein outward spreading and/or bending of the crucible segments is substantially eliminated to improve crucible durability in production applications where downtime is to be minimized.

SUMMARY OF THE INVENTION

The invention contemplates an improved segmented, metal crucible for use in the induction melting of metals that eliminates potential sources of contamination heretofore associated with segmented, metal crucibles.

The invention also contemplates an improved segmented, metal crucible for use in the induction melting of metals wherein the crucible includes means for substantially preventing spreading of the crucible segments during use.

The invention further contemplates an improved method of melting non-reactive metals, reactive metals, refractory metals as well as intermetallic compounds in a segmented metal crucible under vacuum or inert gas backfill conditions wherein sources of melt contamination heretofore associated with the crucible are substantially eliminated to improve melt cleanliness.

In one embodiment of the invention, the crucible includes an upstanding sidewall formed of a plurality of upstanding metal segments disposed in side-by-side relation about a longitudinal axis of said crucible. Each segment includes an inner wall facing the longitudinal axis for forming, together with the inner walls of other segments, a chamber for receiving the metal. Each segment is spaced apart from a next adjacent segment by a longitudinal gap that communicates with the chamber and extends outwardly from the chamber to the exterior of the sidewall. Each gap is free of refractory or other packing material that could constitute a potential source of melt contamination. Moreover, each gap is so sized in a width dimension where the gap and the chamber communicate as to substantially prevent penetration therein of metal in the molten state when the inner walls are initially directly contacted by the metal in the molten state. The crucible further includes means for inducing an alternating electrical current in the metal in the chamber to heat the metal to the molten state and means for cooling the segments to eventually form a solidified metal skull directly on the inner walls of the segments.

In another embodiment of the invention, the crucible includes an upstanding sidewall formed of a plurality of upstanding metal segments disposed in spaced apart side-by-side relation about a longitudinal axis of said crucible to form a chamber for receiving the metal, and restraining means disposed about upper portions of the crucible segments for preventing outward expansion or spreading of said segments away from said longitudinal axis.

The crucible of the invention can be used to melt a metal charge for over-the-lip casting processes, continuous ingot withdrawal processes and other processes requiring delivery or a source of molten metal. For over-the-lip casting, the crucible includes a base plug to form a bottom of the crucible chamber. For the continuous ingot withdrawal process, the crucible includes an open bottom to accommodate an ingot withdrawal mechanism.

DETAILED DESCRIPTION OF THE INVENTION

Figure 1:
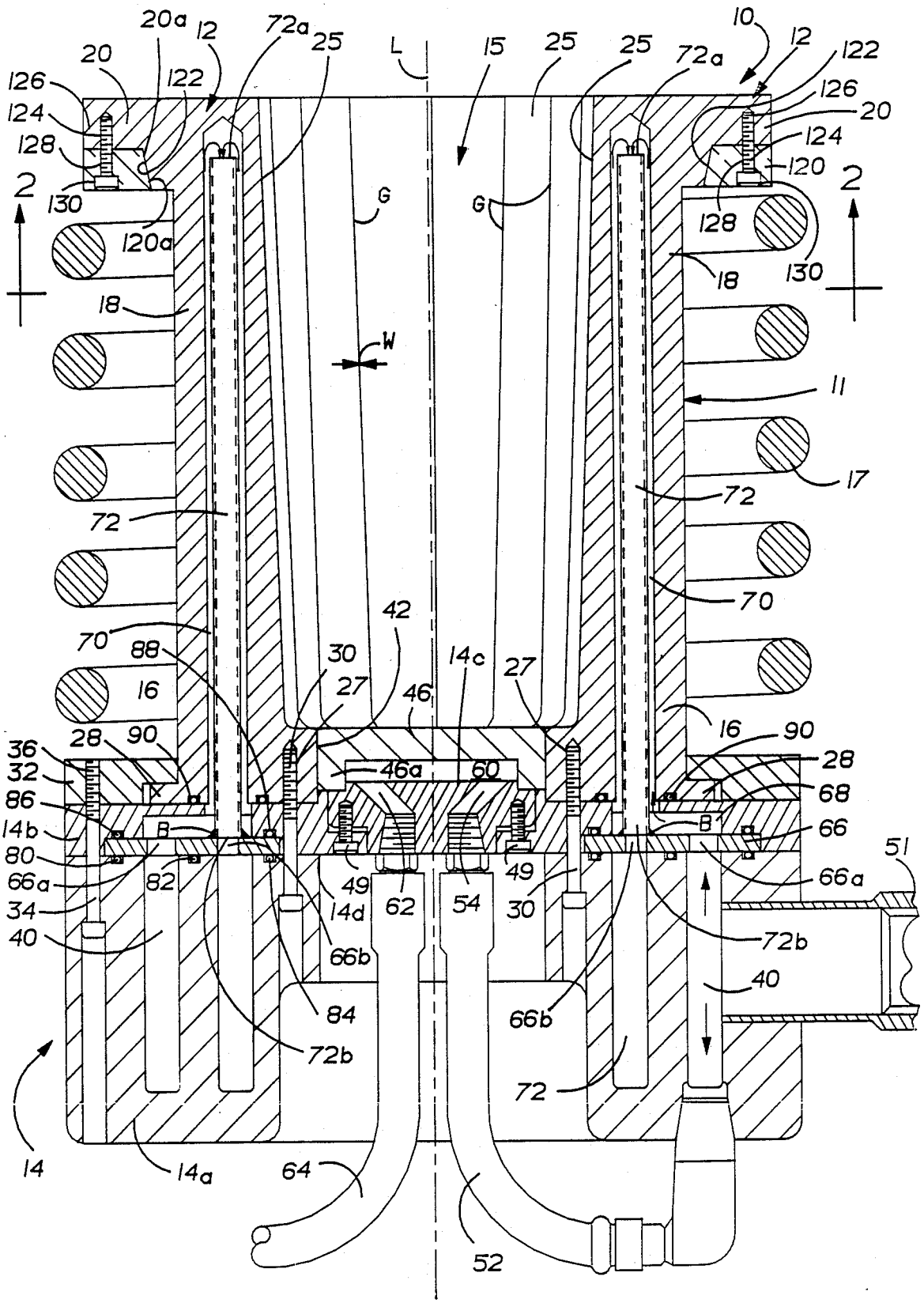
FIG. 1 is a longitudinal cross-sectional view of a crucible constructed in accordance with the invention.
Figure 2:
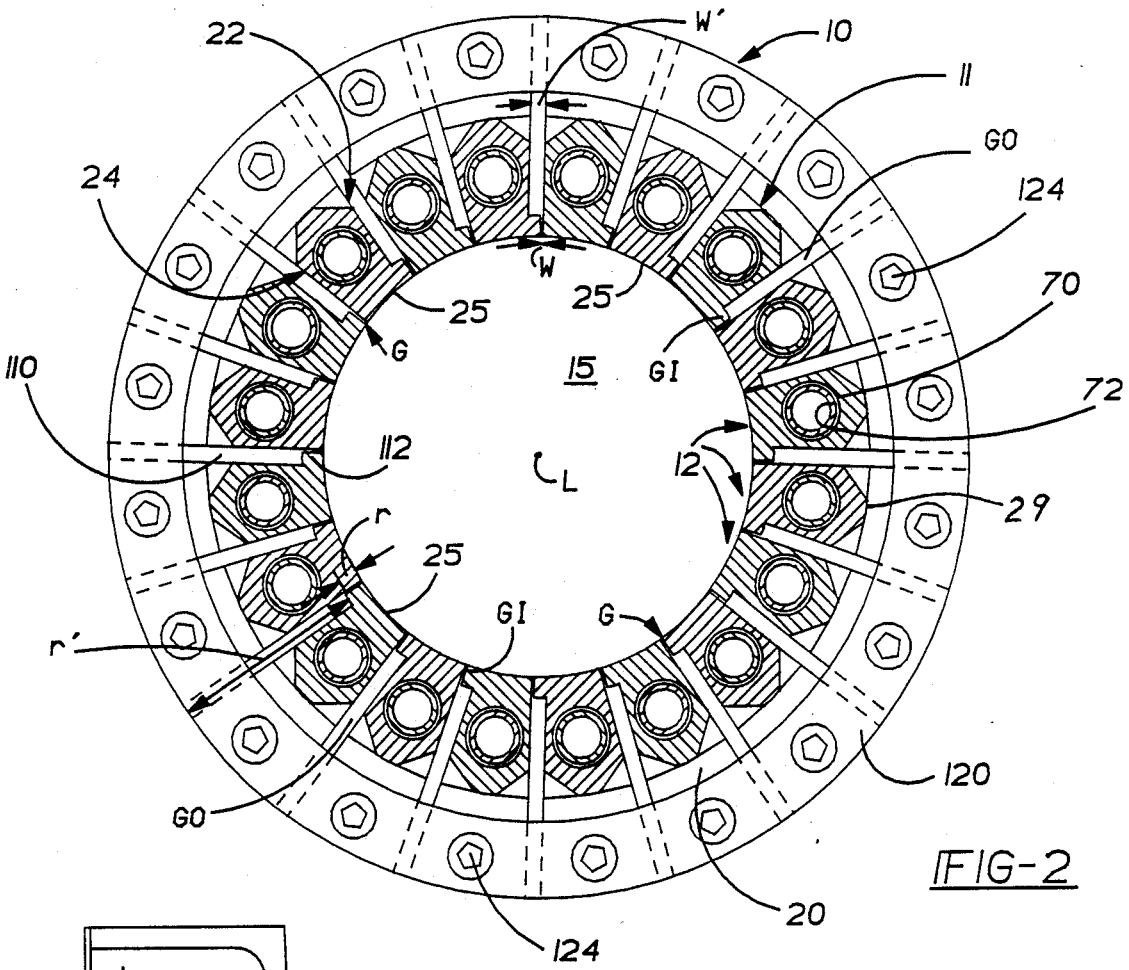
FIG. 2 is a cross-sectional view taken along lines 2—2 of FIG. 1 showing the individual metal segments arranged side-by-side about the longitudinal axis of the crucible.

FIGS. 1–2 illustrate a crucible 10 in accordance with the invention. The crucible 10 includes an upstanding sidewall 11 formed of a plurality of individual upstanding segments 12 made of a highly heat conductive metal, such as preferably cooper. The crucible segments 12 are arranged in a side-by-side, annular relationship or array on a support base 14 about a longitudinal axis L of the crucible to form a crucible chamber 15. The crucible chamber 15 receives the metal (not shown) to be melted and contains the melt formed when the metal is subsequently heated by energization of induction coil 17 disposed about the sidewall 11.

Each segment 12 includes a lower segment foot 16, an upstanding segment sidewall 18 and an upper flange 20 extending radially outward relative to the axis L. Defined between the opposite radial sides 22, 24 of each segment is an inner wall 25. From FIGS. 1–2, it is apparent that the inner walls 25 of the segments 12 face the longitudinal axis L and collectively define the crucible chamber 15. As will be explained in more detail hereinbelow, the segments 12 are spaced apart from one another by longitudinal gaps G that communicate on the inside with the crucible chamber 15 (i.e., the gaps G open into the chamber 15) and that extend outwardly to the exterior side 29 of the sidewall 11 to break up induced electrical currents in the sidewall 11, thereby permitting the induction field generated by induction coil 17 to couple with the metal charge in the crucible chamber 15 to heat and melt same. The exterior side 29 may include chamfered corners as shown in FIG. 2 to reduce the amount of copper used in the sidewall 11.

As mentioned, the segments 12 are arranged in an annular, side-by-side array on the support base 14 which includes lower and upper base members **14*a*, 14*b* that constitute part of a water manifold assembly of the crucible 10 as will be described in detail hereinbelow. The lower foot 16 of each segment 12 is supported on the upper base member 14*b* when the segments 12 are arranged in the annular, side-by-side array. In particular, the lower foot 16 of each segment 12 includes a bottom wall 26 (FIG. 3) resting on the upper base member 14*b* and having a threaded hole 27 extending upwardly from the bottom wall 26 on the inner periphery thereof. As a result, each segment 12 can be releasably fastened to the support base 14 by a cap screw 30 extending through the lower and upper base members 14*a*, 14*b* and threaded into the tapped hole 27 of each segment 12 as shown in FIG. 1. Moreover, an arcuate, outer, radial shoulder 28 of each segment foot 16 is also releasably clamped to the support base 14 by an annular clamping ring 32 and a plurality of circumferentially spaced apart cap screws 34 extending through the lower and upper base members 14*a*, 14*b* and threaded into tapped holes 36 in the clamping ring 32. In this way, the segments 12 are releasably held in the annular, side-by-side array on the support base 14**.

When the segments 12 are so held on the support base 14, the inner walls 25 of the segments 12 collectively form the crucible chamber 15 as mentioned hereinabove. In addition, the foot 16 of each segment 12 includes a lower inner wall 42. The inner walls 42 of the segments 12 collectively form a central cylindrical recess at the base of the crucible chamber 15. Received in the cylindrical recess is a metal base plug or member 46 that forms the bottom of the crucible chamber 15. The base plug 46 may be made of the same metal; e.g., copper, as the segments 12 or it may be made of another metal, for example, a refractory metal or a metal which is the same as the metal being melted in chamber 15.

The base plug 46 includes a downturned lip **46*a* that sealingly abuts a portion of the upper base member 14*b* and a central base member 14*c*. The central base member 14*c* is received in a central aperture 14*d* in the upper base member 14*b* and is fastened to the upper base member 14*b* by a plurality of circumferentially spaced apart screws 49**.

As referred to hereinabove, the lower and upper base members **14*a*, 14*b* in part form a water manifold assembly for cooling the segments 12 as well as the base plug 46. The lower base member 14*a* includes an outer, annular water inlet manifold 40 receiving cooling water from a conventional source (not shown) through an inlet fitting 51. A portion of the cooling water in the inlet manifold 40 is circulated throuqh each segment 12 while the remainder of the cooling water in the inlet manifold 40 is circulated beneath the base plug 46. In particular, referring to FIG. 1, the inlet manifold 40 supplies cooling water to a flexible conduit 52, an inlet bore 54 in the central base member 14*c* and then into a cooling chamber 60 formed beneath the base plug 46. The cooling water is exhausted from chamber 60 via an outlet passage 62 in the central base member 14*c* and through flexible outlet conduit 64** to drain or to a heat exchanger for reuse.

Again referring to FIG. 1, the inlet manifold 40 supplies cooling water to each segment 12 through an apertured manifold ring 66, annular manifold chamber 68 formed in the upper base member **14*b* and then into a cooling passage 70 provided in each segment 12. The cooling water flows upwardly in each cooling passage 70 around a coolant return tube 72 disposed concentrically in each cooling passage 70. The cooling water then flows into the upper open end 72*a* of the coolant return tube 72 and downwardly out the open lower end 72*b* into an inner, annular, exhaust manifold 72 formed in the lower base member 14*a*. An outlet fitting (not shown) is connected to exhaust manifold 72** for discharging the cooling water to drain or to a heat exchanger for reuse.

In FIG. 1, the manifold ring 66 is shown disposed between the inlet manifold 40 in the lower base member 14*a* and the annular manifold chamber 68 formed in the upper base member 14*b*. The manifold ring 66 comprises a one-piece annulus having outer apertures 66*a* spaced circumferentially therearound so as to be disposed beneath each segment 12 for providing a flow of cooling water to the cooling passage 70 in each segment 12. The manifold ring 66 also includes inner apertures 66*b* spaced circumferentially apart so as to be disposed beneath the lower end 72*b* of each respective return tube 72, as shown, so as to receive the cooling fluid therefrom. The lower end 72*b* of each tube 72 is brazed at B to the manifold ring 66.

Suitable o-ring seals 80, 82, 84, 86, 88 are provided about the manifold ring 66 as shown in FIG. 1 to prevent leakage of cooling water between the manifold ring 66 and the lower and upper base members 14*a*, 14*b*. Similarly, the bottom wall 26 of each segment 12 includes an o-ring seal 90 extending about the bottom end of each coolant passage 70 as shown to prevent coolant leakage between each segment foot 16 and the upper base member 14*b*.

The longitudinal gaps G are provided between adjacent segments 12 to maintain sufficient electrical resistance between the segments 12 around the circumference of the crucible 10 to hinder and break up undesirable induced circumferential electrical eddy currents in the crucible and thus allow the induction field (generated by induction coil 17) to couple with the metal in the crucible chamber 15 for purposes of heating and melting the metal to the molten state. Each longitudinal gap G includes an inner portion GI so reduced in a circumferential width dimension w where the inner portion GI and the crucible chamber 15 communicate as to substantially prevent the molten metal from penetrating into the gaps G upon initial melting of the metal charge in the chamber 15 prior to the development of a solidified metal skull against the inner walls 25. In particular, during initial melting of the metal charge as a result of energization of the induction coil 17, the molten metal directly contacts the inner walls 25 of the segments 12 for a period of time until the internal water cooling of the segments causes a solidified metal skull to freeze directly against the inner walls 25. The width dimension w is selected to prevent the molten metal from entering the gaps G during that period of time prior to the formation of the solidified metal skull directly against the inner walls 25. A circumferential width dimension w of less than 0.006 inch, preferably less than 0.003 inch, is selected for this purpose.

Importantly, in spite of the smallness of the width dimension w of each inner portion GI, the thin oxide tarnish or film formed in-situ in ambient air on the facing sides 22, 24 of the segments 12 has been found to provide sufficient electrical resistance between the adjacent segments 12 at the narrow inner portion GI to break up induced equatorial eddy currents to a sufficient degree to allow the induction field to couple with the metal charge in the crucible chamber 15. This insulative capability of the oxide tarnish or film at the inner portions GI of the gaps G is unexpected and surprising given the thinness of such ambient air-formed oxide films. Although not required, the thickness of the oxide film on each side 22, 24 can be increased by subjecting the segments 12 to an intentional higher temperature oxidizing pretreatment in air prior to assembling the segments 12 in the annular, side-by-side array on the support base 14.

Figure 3:
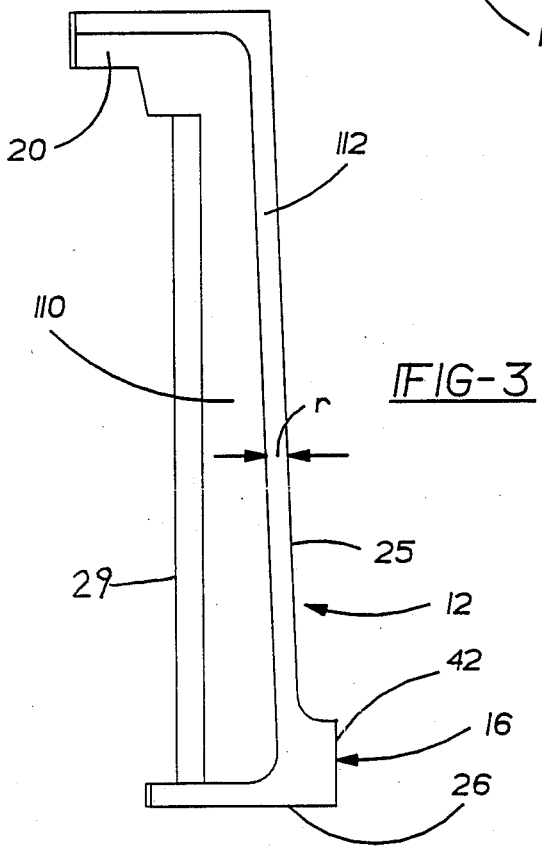
FIG. 3 is a side elevation of an individual crucible segment.

The radial dimension r, FIGS. 2–3, of each inner portion GI is controlled to maintain the area of each narrow inner portion GI to a minimum consistent with its intended function as stated hereinabove. A radial dimension r of about 0.12 inch has been used successfully to this end.

Each longitudinal gap G also includes an outer portion GO that contributes to the electrical isolation of one crucible segment 12 from the next adjacent crucible segment. To this end, each outer portion GO is enlarged in a circumferential width dimension w, and radial dimension r, compared to the inner gap portion GI (i.e., compared to dimensions w and r of the inner portion GI).

As shown best in FIG. 2, each longitudinal gap G is formed between the sides 22, 24 of adjacent segments 12. In particular, the side 22 of each segment 12 includes an outer recess 110 and an inner raised land 112 while the facing side 24 of each segment 12 is configured as a vertical, planar surface such that the gap G is formed between adjacent segments 12 when they are arranged in the annular, side-by-side array on the support base 14.

From FIG. 2, it is apparent that the longitudinal gaps G are completely free of refractory or other packing and spacer material (hereafter collectively referred to as packing material) that constitute potential sources of melt contamination heretofore associated with prior art segmented crucible constructions used in the induction melting of metals. As will be discussed more fully hereinbelow, the cleanliness of the melt contained in the crucible chamber 15 is thereby significantly improved.

Referring to FIG. 1, the upper flanges 20 of the segments 12 are restrained against outward (radial) expansion or spreading away from the axis L by a restraining means in the form of a non-conductive (e.g., MICRATA® phenolic resin material), one-piece retaining ring 120. A portion of the retaining ring 120 is received in a recess 122 formed beneath each flange 20 adjacent its outer periphery for protection from potential damage by the introduction of the solid metal charge into the crucible chamber 15 as well as molten metal confined in the chamber and poured over the flanges 20 if the crucible is used in over-the-lip casting applications. That portion of the retaining ring 120 received beneath each flange 20 is fastened to the flange 20 of each segment 12 using a nylon or other electrically non-conductive screw 124 threaded into a threaded hole 126 on the underside of each flange 20. The retaining ring 120 includes a plurality of threaded holes 128 and associated counterbores 130 aligned coaxially with the holes 126 for receiving a respective screw 122.

Referring to FIG. 1, the retaining ring 120, when fastened to the flanges 20, will exert a radially inward restraining pressure on upper portions of the segments by virtue of the chamfered inner annular surface 120*a* of the retaining ring 120 engaging a complimentarily chamfered or tapered outer, arcuate surface 20*a* machined on each flange 20.

A crucible 10 as shown in FIGS. 1–2 was fabricated and installed in a vacuum chamber for successively melting two charges of IN713C nickel base superalloy. The first charge melted in the crucible included 10 pounds of the IN713C superalloy in ingot form. The second charge melted included 15 pounds of the IN713C in the same form. These first and second charges were successfully melted in succession in the crucible without the use of a $CaF_2$ type lining (skull) and without any packing or other material whatsoever in the gaps G between the crucible segments 12. The charges melted easily and superheats of at least 30° F. were attained. The molten charge was allowed to solidify in the crucible in each melting trial and the resulting solidified slugs were easily extracted from the crucible. There was no evidence of metal penetration into the intersegment gaps G, suggesting that no skull locking problem will be experienced with the crucible 10.

Examination of the crucible segments 12 verified that no arcing or localized melting between the crucible segments 12 occurred during use. The combination of the longitudinal gaps G and the oxide tarnish or film separating adjacent sides 20, 22 of the segments 12 was sufficient to inhibit equatorial induced current flow around the crucible circumference and permit the induction field generated by the induction coil 90 to heat and melt the metal charge in the crucible chamber 15. No evidence of outward spreading of the upper portions of the crucible segments 12 was observed following these casting trials.

The crucible and melting process of the invention described hereinabove are advantageous in that there is no need for a $CaF_2$ type crucible lining (skull) and no need for refractory packing material in the gaps G between the segments 12. The invention thus provides a clean, "ceramicless" crucible which reduces melt contamination from sources heretofore associated with segmented, metal crucibles and enables the production of cleaner castings with reduced levels of inclusion contaminants. Moreover, the crucible and method of the invention are further advantageous in that the outward spreading of upper portions of the crucible segments is substantially prevented, rendering the crucible durable enough to perform over extended time periods in a production environment.

In addition, since the crucible segments 12 are preferably individually machined with the features described hereinabove and are releasably secured at their lower ends to the support base 14 and releasably restrained against outward expansion at their upper portion, any damaged segment can be easily replaced with a like, individually machined segment 12 without the need to replace any other undamaged segment 12 of the crucible. However, the invention is not limited to use of individually machined segments 12 to form the crucible 10. For example, although less preferred, the crucible 10 can be machined from a single monolithic copper forging.

The crucible 10 may be used to melt a metal charge for over-the-lip casting processes, continuous ingot withdrawal processes (e.g., as shown in U.S. Pat. 3,775,091) and other processes requiring delivery or a source of molten metal. Those skilled in the art will appreciate that the crucible 10 can be modified within the scope of the present invention for carrying out a particular casting process. For example, for the continuous ingot withdrawal process, the bottom of the crucible 10 would be open to permit entry and movement of an ingot withdrawal mechanism such as shown in aforementioned U.S Pat. No. 3,775,091.

In accordance with the method of the invention, non-reactive metals (such as superalloys), refractory metals (such as hafnium, molybdenum, niobium), reactive metals (such as titanium and its alloys) and intermetallics (such as aluminides) are melted in the crucible 10 described hereinabove by suitable energization of the induction coil 17 and under vacuum or an inert gas backfill, as desired, to improve melt cleanliness and the melt is then cast using the aforementioned over-the-lip casting process, ingot withdrawal process or other casting process.

Although less preferred in accordance with the invention, a thin layer (not shown) of low conductivity metal, such as titaniun, or non-conductive refractory material, such as boron nitride, may be present in the inner portions GI of the gaps G to enhance the action of the induction field on the metal charge in the crucible chamber 15 and thereby improve melting efficiency. The metal or refractory material can be applied directly to one or both of the sides 22, 24 of the segments 12. This approach may be used, for example, in melting a charge in the crucible chamber 15 where cleanliness of the melt is of less concern but where it is necessary to minimize outward spreading of the upper portions of the segments 12 by use of the retaining ring 120.

Furthermore, while the invention has been described hereinabove in terms of specific embodiments thereof, it is not intended to be limited thereto but rather only to the extent set forth hereafter in the following claims.

I claim:

1. A crucible for heating a metal to the molten state, comprising:

(a) an upstanding sidewall formed of a plurality of upstanding metal segments disposed in side-by-side relation about a longitudinal axis of said crucible, each segment having an inner wall facing said axis for forming, together with the inner walls of other segments, a chamber for receiving the metal, each segment being spaced apart from a next adjacent segment by a longitudinal gap that communicates with the chamber and extends outwardly from said chamber to the exterior of said sidewall with each gap between adjacent segments being free of packing material and so fixed in a width dimension where said gap and said chamber communicate as to be small enough to substantially prevent penetration of metal in the molten state therein until a solidified metal skull is formed directly on said inner walls and large enough to sufficiently electrically isolate adjacent segments to allow induction melting of the metal in said chamber, (b) means for inducing an alternating electrical current in the metal in the chamber to heat the metal to the molten state, and (c) means for cooling the segments to eventually form the solidified metal skull directly on said inner walls.

2. The crucible of claim 1 wherein the means for cooling the segments comprises a coolant passage internal of each segment and means for supplying coolant to each coolant passage.

3. The crucible of claim 1 wherein each gap includes an inner portion communicating with the chamber and an outer portion communicating with the exterior of the sidewall, said outer portion being enlarged in the width dimension as compared to said inner portion.

4. The crucible of claim 3 wherein the inner portion of said gap includes a width dimension that is less than about 0.006 inch.

5. The crucible of claim 3 wherein said width dimension is less than about 0.003 inch.

6. The crucible of claim 1 wherein the adjacent segments include facing sides forming said gap, at least one of said sides having (a) an inner raised land that forms a portion of the inner wall of said segment and (b) an outer recess.

7. The crucible of claim 4 wherein the adjacent segments include facing sides forming said gap therebetween, said sides having an oxide film formed in-situ thereon sufficient for electrical isolation purposes.

8. The crucible of claim 1 including means disposed about upper portions of said segments for restraining outward expansion of said segments away from said axis.

9. The crucible of claim 8 wherein said means for restraining movement comprises a nonconductive retaining ring disposed exteriorly about the upper portions of said segments.

10. The crucible of claim 9 wherein each segment includes an outwardly extending upper flange for engagement by a portion of said non-conductive retaining ring.

11. The crucible of claim 1 wherein each segment is individually machined such that a damaged segment can be replaced with a like undamaged individually machined segment without the need to replace any other undamaged segment of said crucible.

12. The crucible of claim 1 wherein a base member is disposed in the bottom of the crucible chamber to form a bottom of said crucible chamber.

13. A crucible for receiving metal, comprising:

(a) an upstanding sidewall formed of a plurality of upstanding metal segments disposed in spaced apart side-byside relation about a longitudinal axis of said crucible to form a chamber for receiving the metal, (b) means for substantially preventing penetration of the metal between the segments, and (c) a non-conductive restraining ring cooperatively disposed about upper portions of said segments for preventing outward expansion of said segments away from said longitudinal axis.

14. The crucible of claim 13 wherein said non-conductive retaining ring is disposed exteriorly about the upper portions.

15. The crucible of claim 14 wherein each segment includes an outwardly extending upper flange for engagement by a portion of said retaining ring.

16. The crucible of claim 14 wherein said upper portions each include an engagement surface adapted to cooperate with a restraining surface of said retaining ring to exert a radially inward restraining force toward said axis.

17. The crucible of claim 16 wherein said engagement surface and restraining surface comprise tapered surfaces.

18. A method of melting metal, comprising:

(a) placing the metal in a crucible chamber formed of a plurality of upstanding metal segments disposed in side-by-side relation about a longitudinal axis of said chamber and spaced apart from a next adjacent segment by a longitudinal gap that communicates with the chamber and extends outwardly from said chamber to the exterior of said segments with each gap between adjacent segments being free of packing material and so sized in a width dimension where said gap and said chamber communicate as to be small enough to substantially prevent the metal initially in the molten state from penetrating into the gaps until a solidified metal skull is formed on said segments and large enough to sufficiently electrically isolate adjacent segments to allow induction melting of the metal in the chamber (b) inducing an alternating electrical current in the metal to heat the metal to the molten state initially in direct contact with the segments, and (c) cooling the segments to eventually form the solidified metal skull directly on the segments.

19. The method of claim 18 including restraining upper portions of the segments from moving away from a longitudinal axis of the crucible chamber.

20. The method of claim 18 including individually machining each segment such that a damaged segment can be replaced by a like undamaged, individually machined segment without the need to replace any other undamaged segment of said crucible.

21. The method of claim 18 wherein a refractory metal is melted in the crucible.

22. The method of claim 18 wherein a reactive metal is melted in the crucible.

23. The method of claim 18 wherein an intermetallic compound is melted in the crucible.

24. The method of claim 18 wherein a non-reactive metal is melted in the crucible.

25. The method of claim 18 further including solidifying the molten metal in the crucible chamber to form an ingot and withdrawing the ingot from an open bottom of the crucible chamber as the ingot is formed.

26. A crucible for heating a metal to the molten state, comprising:

(a) an upstanding sidewall formed of a plurality of upstanding metal segments disposed in side-by-side relation about a longitudinal axis of said crucible, each segment having an inner wall facing said axis for forming, together with the inner walls of other segments, a chamber for receiving the metal, adjacent segments having facing sides transverse to their inner walls and so spaced apart as to form a longitudinal gap therebetween that communicates with the chamber and extends outwardly from said chamber to the exterior of said sidewall, each gap between adjacent segments including an inner portion communicating with said chamber and an outer portion communicating with the exterior of the side wall, said inner portion of each gap being free of packing material and so sized in a width dimension as to be small enough to substantially prevent penetration of metal in the molten state therein until a solidified metal skull is formed directly on said inner walls and large enough to sufficiently electrically isolate adjacent inner portions to allow induction melting of the metal in said chamber, said outer portion of each gap being free of packing material and having a greater width dimension than said inner portion, (b) means for inducing an alternating electrical current in the metal in the chamber to heat the metal to the molten state, (c) means for internally cooling each segment to eventually form the solidified metal skull directly on said inner walls.

27. A crucible for heating a metal to the molten state, comprising:

(a) an upstanding sidewall formed of a plurality of upstanding metal segments disposed in side-by-side relation about a longitudinal axis of said crucible, each segment having an outwardly flanged upper end and an inner wall facing said axis for forming, together with the inner walls of other segments, a chamber for receiving the metal, adjacent segments having facing sides transverse to their inner walls and so spaced apart as to form a longitudinal gap therebetween that communicates with the chamber and extends outwardly from said chamber to the exterior of said sidewall, each gap between adjacent segments including an inner portion communicating with said chamber and an outer portion communicating with the exterior of the side wall, said inner portion of each gap being free of packing material and so sized in a width dimension as to be small enough to substantially prevent penetration of metal in the molten state therein until a solidified metal skull is formed directly on said inner walls and large enough to sufficiently electrically isolate adjacent inner portions to allow induction melting of the metal in said chamber, said outer portion of each gap being free of packing material and having a greater width dimension than said inner portion.

(b) means for inducing an alternating electrical current in the metal in the chamber to heat the metal to the molten state, (c) means for internally cooling each segment to eventually form the solidified metal skull directly on said inner walls, and (d) a non-conductive restraining ring disposed beneath the outwardly flanged upper ends of said segments and fastened to said upper ends as to prevent outward expansion of said segments away from the longitudinal axis.

* * * * *

UNITED STATES PATENT AND TRADEMARK OFFICE

CERTIFICATE OF CORRECTION

PATENT NO. : 4,923,508

DATED : May 8, 1990

INVENTOR(S) : Randall S. Diehm et al.

It is certified that error appears in the above-identified patent and that said Letters Patent is hereby corrected as shown below:

Column 6, line 6, after "minimum" insert --,-- therefor.

IN THE CLAIMS:

Column 8, line 39, "fixed" and insert --sized-- therefor.

Signed and Sealed this

Thirty-first Day of August, 1993

Bruce Lehman

*Attest:*

BRUCE LEHMAN

*Attesting Officer*

*Commissioner of Patents and Trademarks*